United States Patent [19]

Gilliland

[11] 4,170,049

[45] Oct. 9, 1979

[54] AQUALOCK CLOSET VALVE

[76] Inventor: Elbert G. Gilliland, 1801 Francis Rd., Knoxville, Tenn. 37919

[21] Appl. No.: 883,163

[22] Filed: Mar. 3, 1978

[51] Int. Cl.[2] ..... E03D 11/00; E03C 1/242; F16K 21/18

[52] U.S. Cl. ..... 4/427; 4/1; 4/205; 137/398; 137/410

[58] Field of Search ..... 4/1, 356, 357, 378, 4/392, 393, 404, 395, 396, 421, 427, 191, 198, 203–206, 381, 382, 391, 394, 397, 400, 405, 413–415, DIG. 1; 137/395, 398, 409, 410; 141/198

[56] References Cited

U.S. PATENT DOCUMENTS

| | | | |
|---|---|---|---|
| 172,600 | 1/1876 | Blessing | 4/205 |
| 1,090,200 | 3/1914 | Cole | 4/427 |
| 1,233,654 | 7/1917 | Dziatkiewicz | 4/205 |
| 1,744,073 | 1/1930 | Gordon et al. | 4/205 |
| 1,956,086 | 4/1934 | Tracy | 4/427 |
| 1,995,358 | 3/1935 | Mace | 4/356 |
| 2,531,475 | 11/1950 | Sceroler | 4/427 X |
| 2,676,666 | 4/1954 | Howe | 137/398 X |
| 2,927,327 | 3/1960 | Flieder | 4/393 |

FOREIGN PATENT DOCUMENTS

| | | | |
|---|---|---|---|
| 7881 | of 1910 | United Kingdom | 4/205 |
| 320752 | 10/1927 | United Kingdom | 4/205 |

*Primary Examiner*—Stuart S. Levy

[57] ABSTRACT

An accessory incorporated between a toilet tank and a toilet, the accessory including a float chamber, into which rising water from the toilet is accessible, so as to lift a float attached to an upwardly extending rod which extends into the toilet tank, so as to pivot a swivel arm against a drain valve ball, in order to move the ball into a close position over the tank drain, and thus stop additional water from flowing from the tank into the toilet.

5 Claims, 2 Drawing Figures

AQUALOCK CLOSET VALVE

This invention relates generally to toilet flushing controls.

It is generally well known, that toilet commode manufacturers design the toilet bowl so that it will hold all of the water in the flush tank without overflowing. However, upon occasion, a waste line can become stopped up in various degrees, in any number of ways, such as by rags or other objects, so that this, in turn, will raise the normal water level in the commode to the point that the bowl will overflow when flushed. This can result in a very disagreeable clean-up operation, in which all kinds of disagreeable material may flow out upon a floor. This situation is, accordingly, in want of an improvement.

Therefore, it is the principal object of the present invention to provide an aqualock closet valve, which automatically shuts off the flow of fresh water from a toilet tank, and into the toilet bowl, when the water level in the toilet bowl has risen to an excessively high position.

Another object of the present invention is to provide an aqualock closet valve, which, in one design, can be readily incorporated into existing plumbing fixtures, so that a new toilet tank and toilet are not necessary to be purchased; and wherein, in another design, the present invention is incorporated into the construction of newly manufactured toilet commodes.

Other objects are to provide an aqualock closet valve, which is simple in design, inexpensive to manufacture, rugged in construction, easy to use and efficient in operation.

Figure 1:
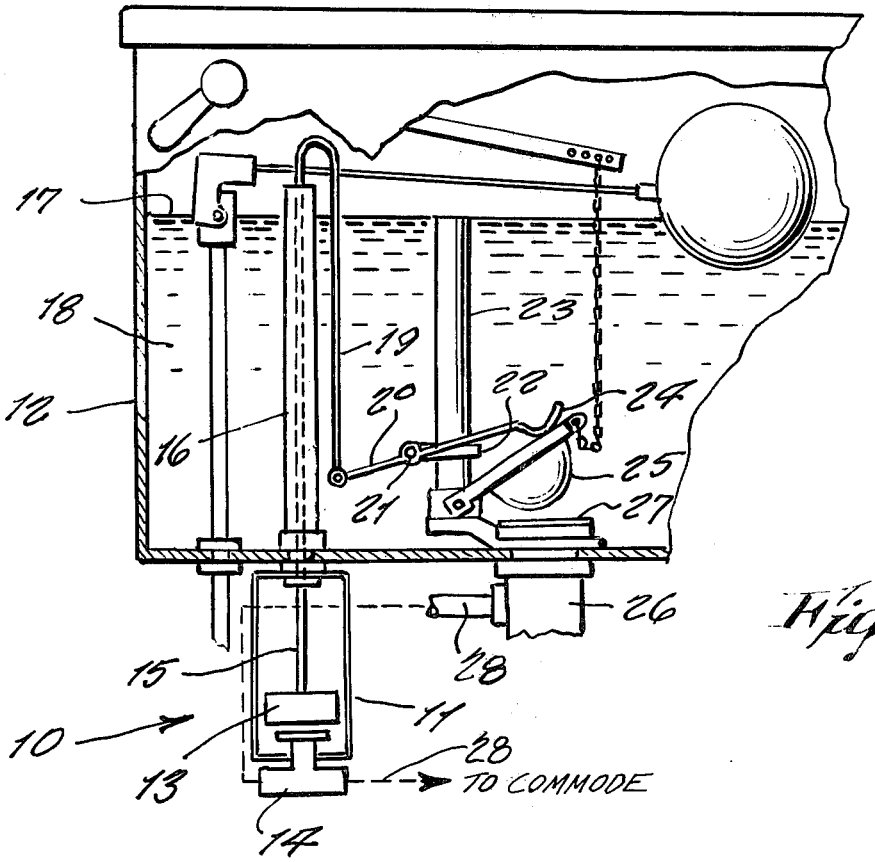
Figure 2:
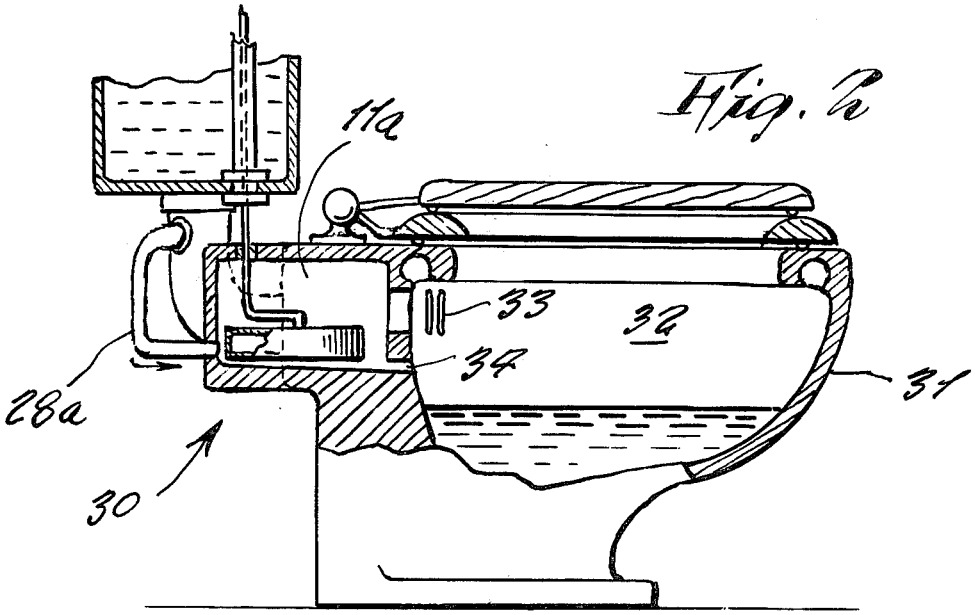

These, and other objects, will be readily evident, upon a study of the following specification, and the accompanying drawing, wherein:

FIG. 1 is a cross-sectional view of a toilet tank, taken from a front side, and showing the present invention incorporated therein; the float ball chamber being shown below the tank, where it is positioned for communication with an upper portion of the commode, and FIG. 2 illustrates a modified construction, in which the above-described invention has the float located inside a hidden chamber, molded in a rear portion of the commode, where there is sufficient space for it, and which chamber can quickly receive a portion of water from the flushing tank, to flow through and quickly disperse into the toilet bowl, through a series of slots therebetween.

Referring now to the drawing in greater detail, and more particularly the FIG. 1 thereof at this time, the reference numeral 10 represents an aqualock closet valve, according to the present invention, wherein there is an auxiliary float chamber 11, that is mounted upon an underside of a toilet water supply tank 12; the interior of the auxiliary float chamber 11 is made to communicate with a water tank and a toilet commode, so that rising water from the commode restricts the flow of water from the auxiliary tank, in order that a float 13, within the chamber, can thus be upwardly lifted. Accordingly, a fitting 14 is connected to branch pipe 28 through a bottom of the chamber 11, allows water to enter the same, and also to leave therefrom.

The float 13 is secured to a lower end of a rod 15, which extends upwardly into the toilet tank 12, and through a center of an upwardly extending pipe 16, that extends above a water level 17 of a water supply 18, contained within the tank. A lower end of the pipe is secured water-tight to a bottom wall of the tank, in order to prevent leakage therearound. The upper end of the rod 15, accordingly, extends outward of the upper end of the pipe, and is bent into a "U"-shape, so that a portion 19 of the rod extends downwardly, and a lower end thereof is then pivotally attached to one end of a swivel arm 20, freely pivoted about a pivot pin 21, stationarily mounted on bracket 22, secured around overflow pipe 23. The opposite end 24 of the swivel arm is positioned to bear against the upper side of a drain valve ball 25, when the drain valve ball is in an upwardly pivoted position, during such time when the water 18 is being flushed outwardly from the tank 12, and through a drain pipe 26 into the toilet commode.

In the present design, the auxiliary float chamber can be positioned within an upper portion of the commode, toward one side, as shown in FIG. 2 or else it may be made to communicate therewith, by means of suitable piping as shown in FIG. 1.

In operative use, when the water level within a toilet commode rises excessively high, the float 13 is thus upwardly lifted, causing the rod to pivot the swivel arm 20, so that the end 24 thereof forces the drain valve ball 25 to be lowered against the drain valve seat 27, upon the upper end of the drain pipe, thus shutting off further flushing of water from the tank into the toilet. A portion of the water, normally being flushed from the tank, is directed into a branch pipe 28 partially represented as a dashed line, and then into the auxiliary float chamber, as it moves through the fitting 14, to effect the present invention when the toilet commode water level rises excessively and blocks the normal flow of water from the fitting through branch pipe 28 into the commode.

In FIG. 2, a modified design of aqualock closet valve 30 incorporated all the above described principles of the aqualock closet valve 10, except that, in this design, the invention is built into a rear of the toilet commode 31. This design is for being incorporated into the manufacture of new commodes. In this design, the auxiliary float chamber **11*a* communicates with the toilet bowl 32 by means of a plurality of slits 33, and also a spillway 34, which communicates with a lower surface of the auxiliary float chamber 11*a*, so that if any solid matter, such as toilet paper and the like, should get into the chamber, they can be flushed outward therefrom, by water from the tank moving through pipe 28*a*** sweeping across the floor surface of the chamber. Thus, a modified design is provided.

While various changes may be made in the detail construction, it is understood that such changes will be within the spirit and scope of the present invention, as is defined by the appended claims.

What I now claim is:

1. In combination with a water supply tank and a flush toilet commode having a water path connected therebetween and a drain valve located in said water path between said supply tank and said toilet commode, an independent aqualock closet valve connected in parallel to said water path for preventing the overflow of the toilet commode, said aqualock closet valve comprising:

an auxiliary float chamber located below said water supply tank and at a position corresponding to a selected upper portion of said toilet commode;

a first conduit for conducting water between said auxiliary flow chamber and said toilet commode; and means for stopping the flow of fresh water from said supply tank to said commode when the water level in said toilet commode results in a corresponding rise of water in said auxiliary float chamber, said means for stopping comprising a float located within said chamber, a pipe extending from said auxiliary float chamber through the bottom of said supply tank and upwardly into the interior of said tank to a level greater than the water level of said tank, a connecting rod having a first and second end, said first end being attached to said float, said rod extending through said pipe and being formed such that said second end extends downwardly, and means attached to said second end for bearing against said drain valve such that water rising to a selected level in said toilet commode results in a corresponding rise in water in said auxiliary float chamber which raises said float means and thereby closes said drain valve connected thereto.

2. The combination of claim 1 wherein said auxiliary float chamber is made integral with said toilet commode.

3. The combination of claim 1 and further comprising a second conduit having a first end connected to said water path at a point between said drain valve and said toilet commode and a second end connected to said auxiliary float chamber for carrying water from said water path into said auxiliary chamber.

4. The combination of claim 1 or 3 wherein said first and second conduits and said auxiliary chamber are interconnected such that fresh water in said first conduit prevents polluted water from said toilet commode from entering said auxiliary chamber.

5. The combination of claim 4 wherein said water flowing through said second conduit is for flushing foreign matter out of said auxiliary float chamber.

* * * * *